US007100913B2

(12) United States Patent
Garcia et al.

(10) Patent No.: US 7,100,913 B2
(45) Date of Patent: Sep. 5, 2006

(54) VALUE SHEET HANDLING APPARATUS

(75) Inventors: Guillermo Garcia, Geneva (CH); Andre Gerlier, Sciez (FR); Roberto Polidoro, Geneva (CH)

(73) Assignee: Mars Incorporated, McLean, VA (US)

( * ) Notice: Subject to any disclaimer, the term of this patent is extended or adjusted under 35 U.S.C. 154(b) by 65 days.

(21) Appl. No.: 10/326,202

(22) Filed: Dec. 19, 2002

(65) Prior Publication Data

US 2003/0132568 A1 Jul. 17, 2003

(30) Foreign Application Priority Data

Dec. 20, 2001 (EP) ..... 01310681

(51) Int. Cl.
*B65H 3/06* (2006.01)

(52) U.S. Cl. ..... 271/21; 271/22; 271/117; 271/19

(58) Field of Classification Search ..... 271/22, 271/21, 19, 117, 119, 126
See application file for complete search history.

(56) References Cited

U.S. PATENT DOCUMENTS

| | | | | |
|---|---|---|---|---|
| 3,645,527 | A * | 2/1972 | Gates | 271/42 |
| 4,492,371 | A | 1/1985 | Kan et al. | |
| 5,195,735 | A | 3/1993 | Sellers | |
| 5,195,736 | A * | 3/1993 | Ishidate | 271/22 |
| 5,295,675 | A | 3/1994 | Hain | |
| 6,032,946 | A | 3/2000 | Marshall et al. | |
| 6,267,369 | B1 | 7/2001 | Regimbal et al. | |
| 6,293,539 | B1 | 9/2001 | Fukatsu et al. | |
| 6,682,064 | B1 * | 1/2004 | Leu et al. | 271/21 |
| 6,715,750 | B1 * | 4/2004 | Gerlier et al. | 271/21 |

FOREIGN PATENT DOCUMENTS

| | | |
|---|---|---|
| EP | 0 436 147 A2 | 7/1991 |
| EP | 1 053 962 A2 | 11/2000 |
| FR | 1.561.951 | 4/1969 |
| FR | 2.231.221 | 12/1974 |
| FR | 2 319 557 | 2/1977 |

OTHER PUBLICATIONS

Patent Abstracts of Japan No. 58089534 (May 27, 1983), 1 page.

* cited by examiner

*Primary Examiner*—Eileen D. Lillis
*Assistant Examiner*—Kaitlin Joerger
(74) *Attorney, Agent, or Firm*—Fish & Richardson P.C.

(57) ABSTRACT

A value sheet handling apparatus comprises an actuating mechanism for exerting pressure onto a value sheet so as to move the value sheet, and further comprises detecting means to detect movement of the value sheet with respect to the actuating mechanism, wherein if the detecting means ascertains that the value sheet has not been moved by the actuating mechanism the pressure exerted Onto die flexible media is increased until motion of the value sheet is detected. Additionally or alternatively, the pressure is varied in dependence on the type of the value sheet. The value sheet is dispensed from a stack by buckling the sheet, the rest of the stack being gripped in the area exposed by the buckling of the sheet.

17 Claims, 7 Drawing Sheets

VALUE SHEET HANDLING APPARATUS

The present invention relates to value sheet handling apparatus for conveying or dispensing banknotes and other value sheets.

Value sheet dispensers are known in a variety of different applications, including banknote acceptors and automated teller machines. Usually the value sheets or notes to be dispensed or conveyed will be in a stack in the apparatus. Typically the conveying or dispensing apparatus works by incorporating a moving actuating mechanism to establish friction between the actuating mechanism and the uppermost and subsequent sheets. A rotating roller is typically used to convey a value sheet from one point to the next, the idea being that the value sheet is urged along a tangential path from the roller at a speed equivalent to the peripheral velocity of the roller. The effect is achieved by urging the roller towards the value sheets so that it presses upon them. The pressure applied by the roller is related to the friction generated between the roller and the uppermost value sheet.

A particular value sheet feed apparatus is disclosed by U.S. Pat. No. 4,605,217. This document discloses a feed-out roller and a friction member which are disposed to form a gap therebetween, through which bills are fed out, one at a time. A gap adjusting mechanism is further provided for changing the size of the gap by moving the friction member relative to the feed-out roller. A pressure sensor detects pressure acting on the friction member to generate a pressure signal. The gap is adjusted on the basis of the pressure signal to provide a constant gap and hence pressure on each banknote. However, this apparatus relies upon a variation in distance between the feed out roller and the friction member to be able to process currency of different thickness and/or rigidity. No provision is made to handle currency of differing age or quality. Furthermore the prior art does not provide for modulating the pressure exerted on each individual value sheet.

The present invention has particular advantage in relation to conveying, aligning and dispensing devices used in conjunction with banknotes. Clearly in this particular field the apparatus must be reliable both in conveying/dispensing the appropriate amount of currency but also in not being prone to jamming or failure. Particular problems arise in manufacturing these devices because the banknotes used in various different countries are made of different materials. Hence the various currencies will have differing rigidity and thickness. For example the thickness of banknotes from a selection of different countries may vary. The rigidity of the notes will depend upon the material from which the note is made.

Generally, a more rigid banknote will require a larger driving force to urge it forward. A weaker banknote will require a lesser driving force. Hence, if a low driving force is applied to a rigid note there is a possibility that the banknote will not be conveyed. Conversely, if a high driving force is applied to a weak banknote there is a strong possibility that the note may be torn or otherwise damaged, and the conveying or dispensing apparatus may become jammed.

The above problem is also not limited to differing currencies. Paper currency generally degrades in circulation. Thus a new banknote will often be more rigid than a banknote that has been in circulation for a few months. Consequently the frictional force, and hence the pressure exerted by the roller, required to convey a rigid note may be too much for an older, used banknote. This may result in a torn or damaged banknote that may jam the machine.

However, if the roller is applied to the banknotes with a reduced pressure, sufficient friction may not be generated to convey a more rigid banknote.

Various value sheet dispensing apparatuses use means to form a buckle in the uppermost value sheet for ease of removal from a stack of value sheets. In apparatus of this type, referred hereinafter to as buckle dispensers, two members are generally used to create the buckle therebetween. Typically, one of the members will be the actuating mechanism. In order that a buckle is formed, sufficient friction must be generated between the actuating mechanism and the value sheet.

In all the above described apparatuses it will be understood from the foregoing that it is difficult to find a roller position or setting which exerts sufficient pressure so as to grip the weakest notes whilst not jamming the machine or damaging the banknotes but having enough grip to convey stronger, more rigid notes.

Typically in prior art applications of this type a spring is used to urge the actuating mechanism towards the value sheets. The spring gives an approximately fixed pressure to each individual value sheet. However, the spring will have an inherent variation, usually plus or minus twenty percent.

Consequently it is an aim of the present invention to provide value sheet conveying apparatus that can take into account variations in properties of value sheets, for example thickness, rigidity and age, when conveying or dispensing the flexible media.

According to one aspect of the invention there is provided a value sheet handling apparatus having moving means for moving at least part of a sheet, the moving means being adjustable in order to make the force applied thereby more likely to cause movement of the sheet, the apparatus further including control means for adjusting the moving means automatically in response to detection of a predetermined condition. The condition may be the fact that a previous operation of the moving means has failed to cause movement of the sheet. Alternatively, or additionally, the moving means may be adjusted in response to a signal representing the type of the value sheet to be dispensed, the type representing the denomination and/or the condition of the banknote.

The moving means, which may incorporate an actuating mechanism, such as a roller, for engaging the sheet, may be arranged so that the actuating mechanism is linearly displaced with respect to the value sheet if the detection means detects that the actuating mechanism has failed to move the value sheet.

The present invention thus allows for the roller to move with respect to the value sheet to exert increased pressure onto a value sheet. Also, in another embodiment of the invention in the form of a buckle dispenser, the actuating roller may be moved substantially along the plane of the stack of value sheets in order to vary the separation between the buckle creating members.

According to a second aspect of the present invention there is provided value sheet handling apparatus comprising an actuating mechanism that is capable of being urged towards a plurality of value sheets such that the actuating mechanism exerts pressure onto the value sheets, characterised in that the apparatus further comprises a control for varying the pressure applied by the actuating mechanism onto each value sheet.

The apparatus may have means to detect movement of a value sheet caused by the actuating mechanism, the arrangement being such that if the detecting means ascertains that the value sheet has not been moved by the actuating mechanism the pressure exerted onto the value sheet is increased until motion of the value sheet is detected.

Alternatively, or additionally, the pressure may be adjusted in accordance with the type of value sheet to be moved, for example the denomination and/or condition of the banknote.

It is envisaged that the pressure applied by the actuating mechanism is adjusted by moving the actuating mechanism relative to a stack of value sheets. This in the preferred embodiment is achieved by adjustment of the actuating mechanism itself. However, in an alternative arrangement it would be possible for the actuating mechanism to be held stationary with respect to the housing of the apparatus and the stack of value sheets urged towards the roller so that the pressure exerted on the uppermost value sheet by the actuating mechanism increases over time until a sensor detects that the uppermost value sheet has been moved.

It is preferred that as each value sheet becomes the uppermost sheet on the stack, the pressure exerted upon it by the actuating mechanism begins at a low level. Therefore weaker banknotes or other value sheets can be conveyed with a reduced chance of damage to the banknote. As the pressure is increased the friction generated between the banknote and the actuating mechanism will increase and more rigid value sheets will be more easily conveyed.

In a preferred embodiment of the present invention, the actuating mechanism is urged towards the value sheets by predetermined steps. Thus the pressure exerted on the flexible media is increased in discrete amounts. In this manner the pressure increase may be handled as a stepped process. A low pressure level is used to begin with and if the sensor does not detect movement then the pressure is increased to the next level. If the sensor still does not detect movement the pressure level is increased to the next stage. This process can then continue until motion of the banknote is detected. Preferably the time delay between each of the steps is of the order of milliseconds.

Preferably the actuating mechanism comprises a roller.

The means to urge the roller towards the value sheets may comprise an electromagnet. The roller may be disposed at one end of a lever. Ideally the electromagnet can attract the end of the lever remote from the roller. The use of an electromagnet as the pressure modulator enables the pressure level to be controlled as a function of current. In one preferred embodiment if current is not supplied to the electromagnet then the roller does not contact the value sheets. Thus in this particular arrangement the current can be used to modulate the different levels of pressure and also release the traction on the value sheets.

However, it is to be understood that the scope of the invention is not to be limited to the use of an electromagnet. For example, a stepper motor and cam arrangement may be used to supply the modulated pressure.

According to a further aspect of the present invention there is provided means for dispensing a first value sheet from a stack of value sheets by causing the first value sheet to form a buckle between two members, characterised in that if a buckle fails to form the separation between the two members is increased.

With buckle dispensers, generally, the wider the gap between actuating member and fixed member the easier it is for a value sheet to be buckled. However, if the separation is too great the chance of buckling a plurality of sheets is increased. The properties of the value sheet also determine how easily the sheets may be dispensed. A rigid sheet will not form a buckle as easily as a pliant sheet. In the buckle dispenser arrangement it is preferred that at the start of a cycle the distance between the actual member and fixed member is at a minimum separation. If the value sheet is not forced to buckle, because, for example, it is too rigid, the separation between the two buckle forming members may be increased. Preferably this is done in discrete steps with movement of the value sheet attempted after each step.

In other buckle dispenser embodiments the actuating member may be held stationary and the fixed member replaced with a movable member. In another preferred embodiment both buckle forming members may be movable towards and away from each other.

In a further aspect of the present invention there is provided means to dispense a value sheet from a stack of sheets by forming a buckle in the sheet between two members wherein at least one of said members is movable to permit alteration of the geometry of the buckle.

In one embodiment, the movable member is resiliently movable so that as the buckle is formed, a different geometry is adopted depending upon the rigidity of the member. Thus, more rigid sheets would tend to move the member to a larger extent, so that the buckle extends over a larger area and is linked to the rest of the sheet by a relatively large radius of curvature. This at least partially compensates for the fact that buckling a rigid sheet normally requires more force. There is a further compensation effect in that although more rigid sheets are normally more difficult to withdraw from the stack, because this involves the flattening of the buckle, this is alleviated by the fact that the movable member causes more rigid sheets to have a greater radius of curvature at the point where the buckle joins the rest of the sheet, thereby making it easier to withdraw the sheet.

In an alternative arrangement, the movable member moves only after the buckle has been formed, in order to facilitate removal of the sheet.

The movable member may be formed from resilient material, and may for example be a sheet, for example made of plastics or rubber. Alternatively, the movable member may be mounted for pivotal movement.

Depending upon the function of the movable member, the member may be moved by the sheet in which the buckle is being formed and/or by an actuator under the control of a control means.

Arrangements according to this aspect of the invention may also permit variation of the separation between buckle forming members.

In a further aspect of the present invention there is provided apparatus for dispensing a value sheet from a stack of value sheets, comprising means to form a buckle in the value sheet to be dispensed, thereby exposing an area of the stack, and means to grip the stack in said area.

This embodiment enables withdrawal of the upper sheet without the risk of further sheets being erroneously withdrawn at the same time.

The present invention is especially advantageous for the handling of banknotes, and particularly for banknotes in machines which dispense notes from stores which are replenished by individually received notes (wherein the notes can be in widely-varying conditions). The present invention is suitable for banknote dispensing systems, automatic alignment systems and the like.

In order that the present invention be more readily understood, specific embodiments thereof will now be described with reference to the accompanying drawings in which.

Figure 4A:
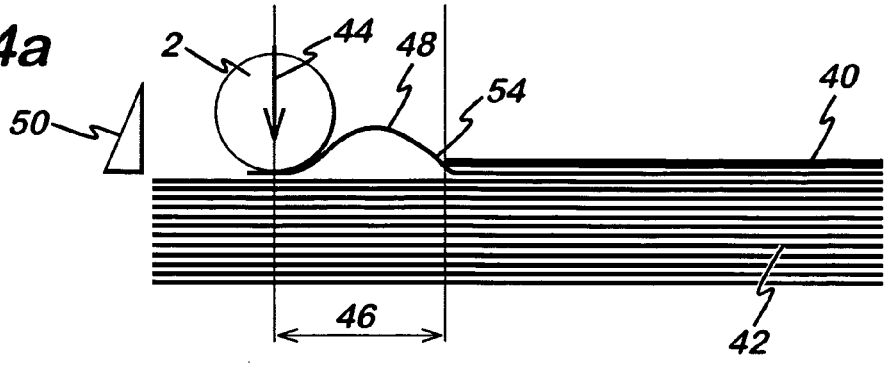
Figure 4B:
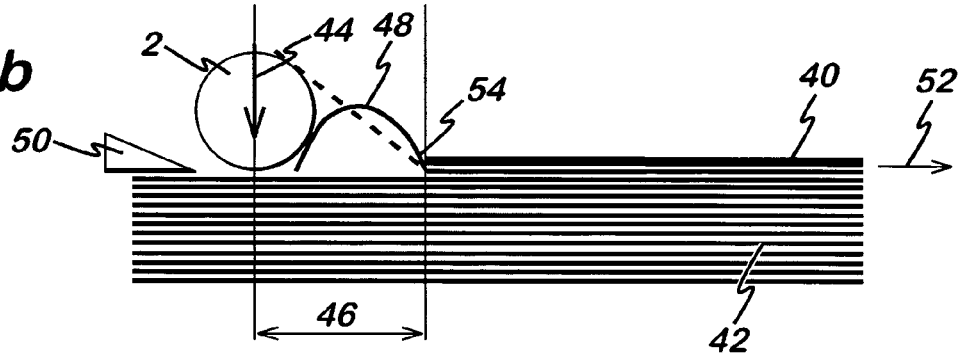
Figure 5:
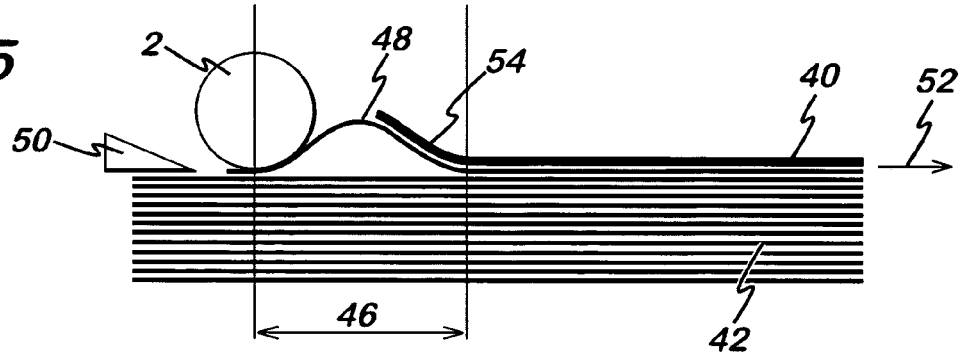
Figure 6:
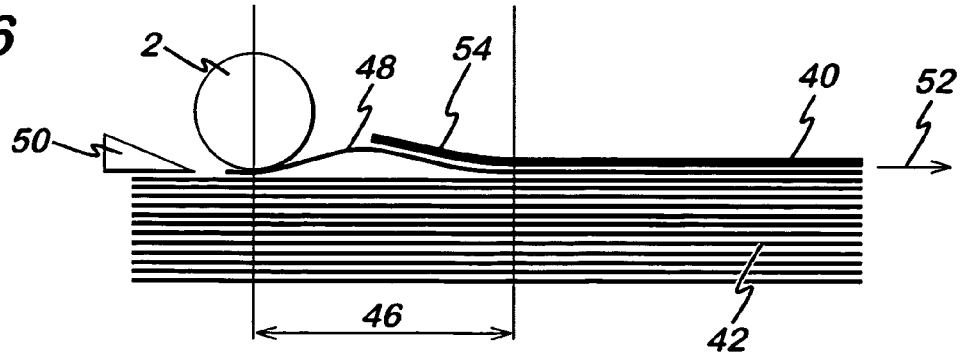
Figure 7A:
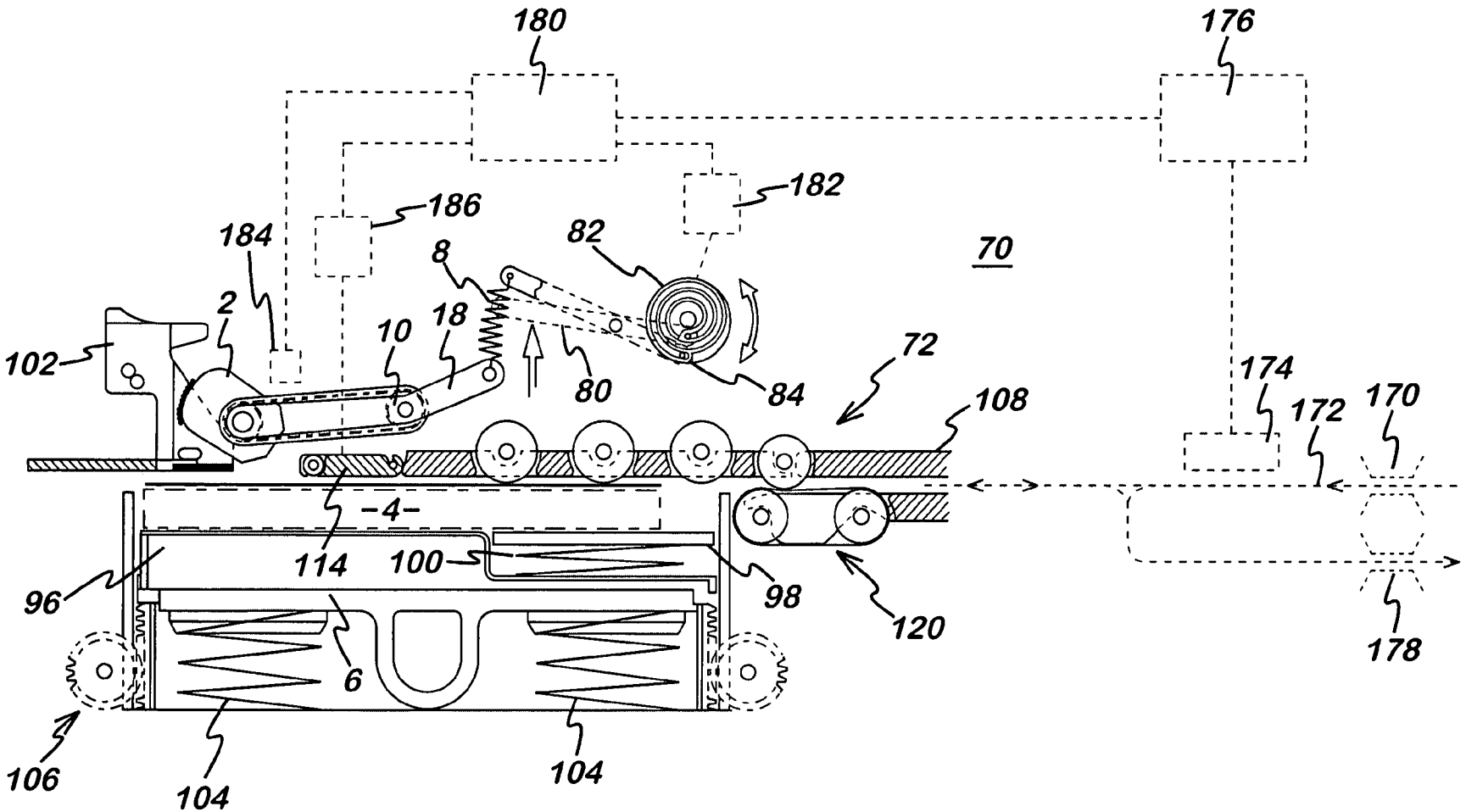

FIGS. 4*a* and 4*b* schematically show different stages of the operation of another embodiment of the invention;

FIG. 5 schematically shows a further embodiment when a sheet is being dispensed;

FIG. 6 shows the embodiment of FIG. 5, when dispensing a stiffer sheet;

FIG. 7*a* shows a further embodiment of the present invention, in the form of a banknote acceptor, illustrating means for extracting a bill from a stack;

FIG. 7*b–f* shows a sequence of bill extraction, using the embodiment of FIG. 7*a;*

Figure 8:
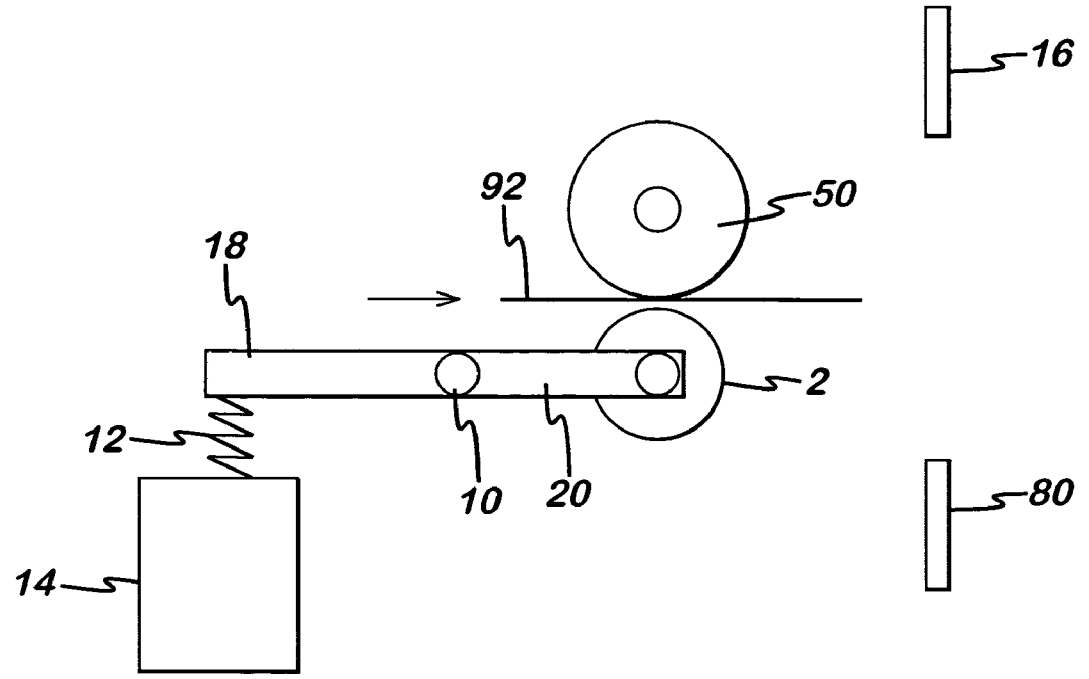
Figure 9:
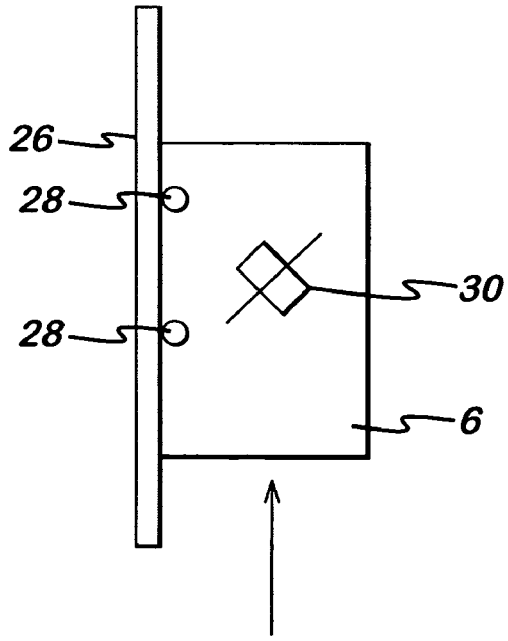

FIG. 8 shows the functional elements of a still further embodiment of the invention; and FIG. 9 is a top view of the functional elements of an automatic value sheet alignment apparatus of another embodiment of the present invention.

Figure 1:
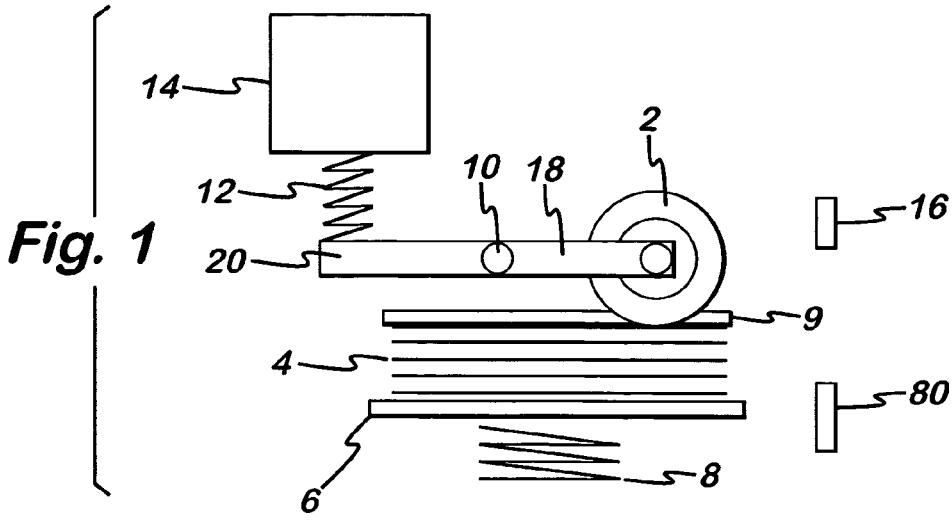
FIG. 1 shows the functional elements of a value sheet dispensing apparatus forming a first embodiment of the present invention.
Figure 2:
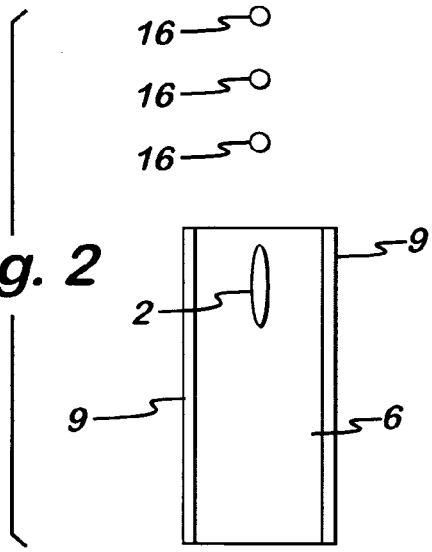
FIG. 2 is a top view of elements of the first embodiment incorporating sensors to detect whether the banknote is being driven and, optionally, at what speed.

Referring to the drawings, and in particular to FIGS. 1 and 2, a value sheet dispensing apparatus comprises an actuating mechanism, which in this embodiment comprises a roller 2 which acts upon the flexible media to be conveyed or dispensed.

Flexible media, in this case banknotes, are stacked one on top of another on platform 6. Platform 6 is urged towards roller 2 by a compression spring 8, the top of the stack being retained by elongate side members 9. For consistency it is convenient for the uppermost banknote of stack 4 to be always at the same height with respect to the roller 2. Thus the roller always exerts the same minimum pressure on the uppermost banknote. As banknotes are removed from the stack 4 the compression spring 8 is able to expand, urging the platform 6 closer towards the members 9.

The figures depict the value sheets stacked in a horizontal orientation. This is for illustrative simplicity. It should be understood that alternative orientations are readily possible and are encompassed within the scope of the present invention. The stack 4 of sheets is depicted flat although it may have a degree of curvature if desired. For example, the stack may be curved upwards at the centre so as to promote the separation of the ends of the top sheet from the stack 4.

The roller 2 is rotatably driven by, for example, a motor (not shown). In this manner the uppermost banknote is urged in the direction of the lower horizontal tangent of the roller's motion.

The rotating roller 2 grips the uppermost banknote and urges it forward. This occurs due to the friction between the roller 2 and the uppermost banknote.

The above described arrangement is typical of sheet dispensing apparatus.

The roller 2 is connected to one end of a lever 18, which is pivoted at point 10. The end part 20 of the lever 18 remote from the roller 2 is acted upon by a compression spring 12. As will be apparent when viewing FIG. 1 the weight of the roller 2 and the pressure from the spring 12 keep the lever 18 in an equilibrium.

An electromagnet 14 is disposed above end 20 of lever 18. The electromagnet comprises an iron core surrounded by a coil. The compression spring 12 is disposed coaxially with the electromagnet 14. When current is supplied to the coil the electromagnet 14 generates a magnetic field. However, when there is no current supply there is no magnetic field generated. End 20 of lever 18 is constructed so as to be permeable to magnetic fields. Therefore end 20 of lever 18 is attracted towards the electromagnet 14 when current is supplied to the coil. It will be apparent from FIG. 1 that this action will urge roller 2 towards the stack of banknotes 4. The greater the current supplied to the electromagnet 14, the greater the attraction between lever 18 and electromagnet 14. Since the electromagnet has to work against the compression spring it is possible to control the amount lever 18 is moved out of equilibrium by varying the strength of the magnetic field.

The embodiment also comprises a sensor disposed in the path of the banknotes. Typically the sensor will comprise one or more LEDs 16 disposed facing corresponding photodiodes 80. When an object moves between the sets of LEDs 16 and photodiodes 80 it is apparent that the light beam has been broken and that there is motion of the banknotes. A series of sets of LEDs 16 and photodiodes 80 may be included in the embodiment, as shown in FIG. 2. This feature allows the velocity of the banknote to be ascertained. It is preferred that the banknote is driven at the same speed as the peripheral velocity of the roller.

In use the roller 2 is pressed against the banknotes with the minimum pressure level. This level may be when there is no current supplied to the electromagnet 14 and is solely governed by the weight of the roller or it may be with a low current supplied to the electromagnet to produce a low strength magnetic field.

As the rotating roller 2 contacts the uppermost banknote, the sensor checks if the banknote has been moved. If the sensor does not detect any movement of the banknote then the magnetic field strength is increased by increasing the current to the electromagnet 14. This in turn attracts end 20 of lever 18 closer to the electromagnet 14. As a consequence the roller 2 is forced closer to the stack of banknotes 4 and hence exerts more pressure onto the uppermost banknote. As the pressure increases, so does the friction between the roller 2 and the uppermost banknote of the stack 4. Hence the rotating roller 2 will drive the value sheet with greater force. The sensor once again checks to see if the banknote has been moved. If not, the process is iterated until the motion sensor detects that the banknote is being moved.

Typically the minimum force applied will be around 30 grams. The first increase may be, for example, to 60 g and then to 90 g and 120 g and so on. However, it is to be appreciated that these figures are arbitrary and that any suitable levels of force may be substituted.

Although typically the rotation of the roller 2 is constant, the rate of rotation may be varied or interrupted as required to achieve better dynamic performance. For example the rotation of the roller 2 may be intermittent, or the roller 2 may be continually rotated but at differing speeds.

Whilst the figures show that the roller 2 of the present invention is of circular cross section, alternative geometric configurations, such as polygons or ellipsoids might be substituted.

Figure 3:
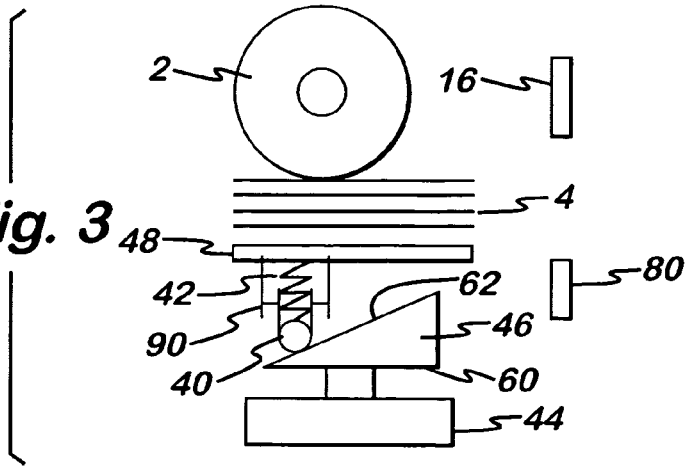
FIG. 3 shows the functional elements of a second embodiment of the present invention illustrating use of a stepper motor and cam arrangement instead of using an electromagnet.

FIG. 3 shows a second embodiment of the present invention in which the stack is urged directly against the roller 2, the side members 9 being omitted, and the pressure variation is achieved by varying the upward force applied to the stack.

In this embodiment the electromagnet 14 and lever 18 are replaced by a stepper motor 44 and a cam 46. The position of the cam 46 is controlled by the stepper motor 44. The stepper motor 44 is capable of rotating the cam 46, about its vertical axis, through one or more full turns of 360 degrees. The motor has discrete intervals through which it turns the cam within the 360 degree turn. For example the stepper motor may assume four different alignments within a full turn. Hence the cam 46 may be rotated by 90 degrees each time.

The cam 46 is shaped so as to give the desired pressure modulation. The cam is circular in plan view and comprises a lower, flat circular face 60 and an angled upper face 62. The lower face 60 is attached to the stepper motor 44. The upper face 62 acts upon a rider 40. The rider 40 is connected to compression spring 42, which in turn is connected to platform 48. As the cam 46 is rotated the height of the cam 46 at the point where rider 40 abuts varies due to the sloped upper face 62 of the cam. Thus, rider 40 is urged upwards as the effective height of the cam 46 increases. The compression spring 42 is compressed and thus the pressure exerted onto platform 48 by the compression spring 42 increases. This, in turn urges the stack of banknotes 4 towards roller 2 with more force. In order that the rider 40 is maintained in a position directly below the compression spring 42, and not forced out of alignment, a telescopic sheath 90 may be disposed about the spring 42.

The present invention is also applicable to buckle dispensers, for example of the type shown in EP-A-1 053 962. In such dispensers, an actuating member such as a roller uses friction on the uppermost banknote of a stack in order to create a buckle in the banknote, which then facilitates the dispensing of that individual banknote from the stack. FIGS. 4*a* and 4*b* show such an arrangement, in which the buckle is formed between the roller 2 and the near end of a member 40 overlying a stack 42 of banknotes of different denominations. In accordance with an aspect of the present invention, the roller 2 is pressed downwardly in the direction 44 by a force which can be varied. It will be appreciated that the formation of the buckle within the laterally extending distance 46 between the roller 2 and the end of the member 40 will require a force that will depend upon the characteristics of the uppermost banknote, and particularly its stiffness. If insufficient force is applied, the buckle will not be formed. If too much force is applied, more than one banknote may be buckled, thus resulting in the risk of dispensing more than one note.

In the embodiment of FIGS. 4*a* and 4*b*, a control means (not shown) is operable to alter the force with which the roller 2 is forced downwardly in the direction of arrow 44 between 9 different levels, referred to as level 1 to level 9, in order of increasing pressure. The control means responds to (a) a signal representative of the denomination of the uppermost banknote (or the denomination of all the banknotes in the stack 42, in the case of a single-denominational store), and (b) a signal from a sensor (not shown) which can detect the presence of the buckle 48.

When the uppermost banknote is to be dispensed, the control means selects the level of the pressure applied by the roller 2 to be either level 1, level 4 or level 7, depending upon the denomination of the uppermost banknote. Denominations having greater rigidity will result in a higher pressure level being selected.

The roller 2 is then rotated by a predetermined amount, for example a single revolution. The control means then checks the sensor to determine whether the buckle 48 has been formed. If not, the pressure applied by the roller 2 is increased to the next level and the roller is driven again in a further attempt to create the buckle 48. This procedure continues until either the buckle 48 has been formed, or the maximum level, level 9, has been reached. If the maximum level has been reached without a buckle having been formed, a signal indicating a jam is generated by the control means.

After the buckle has been formed (FIG. 4*a*), the uppermost banknote can then be withdrawn in any one of a number of different ways. In the preferred embodiment, the area of the stack 42 which has been exposed by the buckling of the uppermost sheet is clamped by a clamping means 50 as indicated in FIG. 4*b*. The roller 2 continues to rotate until the end of the uppermost banknote where the buckle is located is free of the roller as shown in solid lines in FIG. 4*b*. The uppermost banknote can then be withdrawn in a direction 52 parallel to its plane by conveying means (not shown). The clamp 50 ensures that only the uppermost note is withdrawn.

In an alternative arrangement, the roller 2 may continue to rotate until the uppermost note adopts the state shown in broken lines in FIG. 4*b*. This reduces the radius of curvature of the note at the area 54 where it is held by the member 40, and thus reduces the force required to withdraw the note in the direction 52, and also makes it less likely that the note will be torn.

FIGS. 5 and 6 show modified embodiments of the invention, in which the member 40 is made of a sheet of resilient material, for example plastics material. The material is preferably very pliant.

FIG. 5 shows an arrangement in which the uppermost banknote is also relatively pliant, which results in a relatively high buckle 48 being formed.

FIG. 6 shows the apparatus when the uppermost banknote is relatively stiff. In this case, the buckle 48 is of significantly less height. However, it is still relatively easy to form the buckle because of the pliancy of the upper member 40. The flexing of the member 40 as a result of the stiffness of the note 48 effectively means that the buckle is formed over a larger area 46, as compared with the situation in FIG. 5. A larger area means that the formation of the buckle is easier, therefore compensating for the difficulties arising from the lack of stiffness of the note.

It will also be noted that the radius of curvature of the stiffer note in the region 54 where the buckle commences is relatively high compared with the situation shown in FIG. 5 with a more pliant note. A larger radius of curvature means that the force required to withdraw the note in the direction 52, which results in flattening of the note, is reduced, thus compensating for the additional force required to straighten a relatively stiff note.

The embodiment of FIGS. 5 and 6 may include an arrangement for varying the pressure produced by the roller 2, but this is not essential.

A particularly preferred embodiment of the conveying apparatus relates to bill dispensing and particularly to extracting a bill from a stack to facilitate dispensing. FIGS. 7*a–f* show a sequence of extracting a bill from a stack for this particular embodiment. This embodiment is a banknote acceptor 70 having a store 72 containing a buckle dispenser.

FIGS. 7*a* to 7*f* are primarily intended to illustrate the store 72; only FIG. 7*a* shows, in broken lines, the remainder of the banknote acceptor 70. This includes a banknote inlet 170 for receiving banknotes which are then conveyed individually along a path 172 past a banknote measuring device 174. The device 174 takes measurements of the banknote, for example using optical sensors, and sends these to a validator circuit 176, which determines whether the banknotes are genuine, and if so the denomination of the banknotes. Depending upon the determination made by the validator circuit 176, the banknote is fed either to an outlet 178, for example if it is determined to be non-genuine, or to the banknote store 72.

A store control means 180 can read from the validator circuit 176 data representing the denominations of the bills stored in a stack 4 in the store 72, and possibly also data representing measured conditions of the banknotes.

The store 72 comprises a roller 2 rotatably mounted on a lever 18. The lever is pivoted at point 10. In the figure lever 18 is depicted as a dogleg; however it is to be understood that substantially any configuration will suffice and may be dictated by the confines of the rest of the apparatus.

The end of the lever 18 remote from roller 2 is acted upon by a spring 8. The spring 8 is also attached to a second pivoted lever 80. The end 84 of lever 80 remote from the spring 8 is associated with a cam 82. Cam 82 is driven by a motor 182 controlled by store control means 180. The cam comprises a spiral groove, into which a part of the end 84 of lever 80 is located. The cam may be rotatably driven by the motor in either clockwise or anti-clockwise directions. Rotating the cam clockwise causes the end 84 of lever 80 to be sent towards the outermost part of the spiral, whereas rotating the cam anti-clockwise causes the end 84 of lever 80 to be sent towards the innermost part of the spiral. FIGS. 7*a–f* show both extremes of the lever's 80 position within the spiral cam 82.

The apparatus further comprises a platform 6. Platform 6 provides a support for the stack 4 of banknotes. Platform 6 further comprises two pusher plates 96, 98. The first pusher plate 96 is integral with or mounted on platform 6. The second pusher plate 98 is mounted on platform 6 by a compression spring 100. The two pusher plates 96, 98 are arranged so that, when freestanding, the plate 98 is biased to a higher level than the plate 96. The stack of banknotes 4 is disposed upon the surfaces of the pusher plates 96, 98.

Platform 6 is mounted upon one or more compression springs 104. These compression springs urge the platform, and hence the banknotes 4, upwardly. Platform 6 is also guided by a rack and pinion device 106.

A pressure member 102 is disposed above and at one end of platform 6. The pressure member 102 is capable of being moved downwardly towards platform 6 and upwardly away from the platform. When a stack of notes 4 is disposed on platform 6 the pressure member, when urged downwardly, is capable of pressing the stack of notes 4 against the platform 6. The pressure applied is sufficient to hold the stack 4 firmly.

A flat member 108 is disposed parallel with, and partially overlapping platform 6. Flat member 108 supports a plurality of drive wheels 110. The drive wheels 110 are arranged to contact the uppermost note in the stack 4 and limit the upward movement of the stack. A motor (not shown) is used to rotate the drive wheels 110.

A conveyor belt 120 is provided for extracting the uppermost banknote. The flat member 108 is parallel with, and overlaps, the conveyor belt 120.

In the illustrated arrangement the roller 2 is not rotationally symmetrical. The outer surface is configured such that in one complete rotation the outer surface of the roller 2 is brought into contact in only a defined arc length of the perimeter. This arc length is shown at 112 in the drawings.

The method of bill extraction and dispensing will now be described, with particular reference to FIGS. 7*a–f*.

Figure 7B:
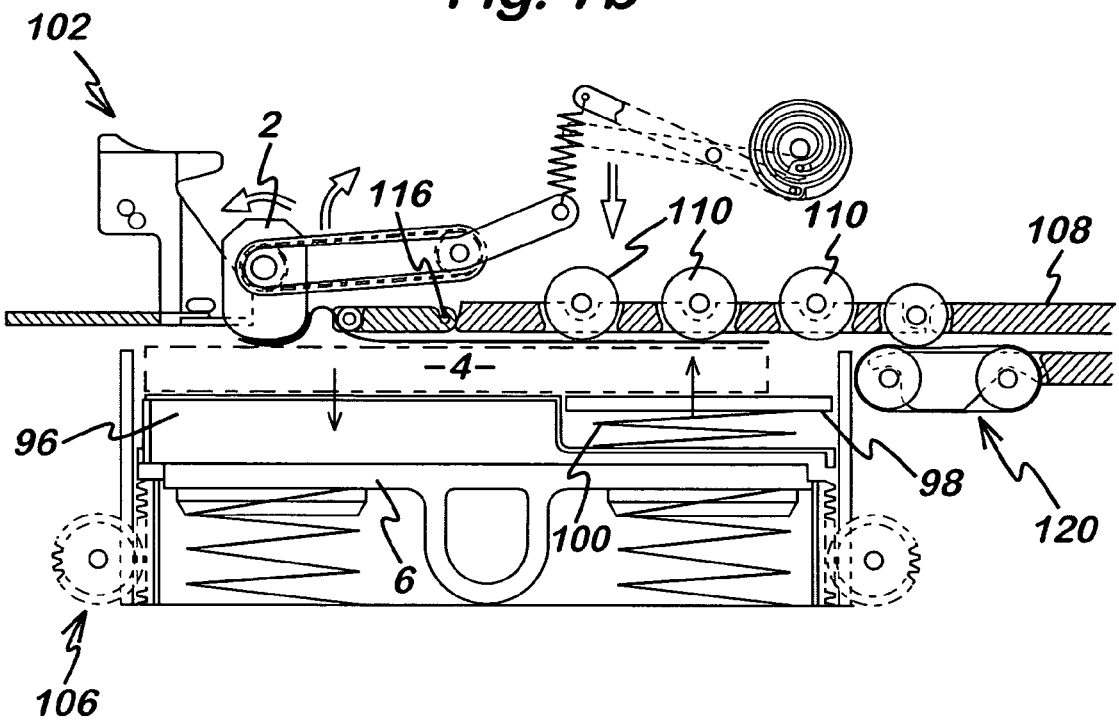
Figure 7C:
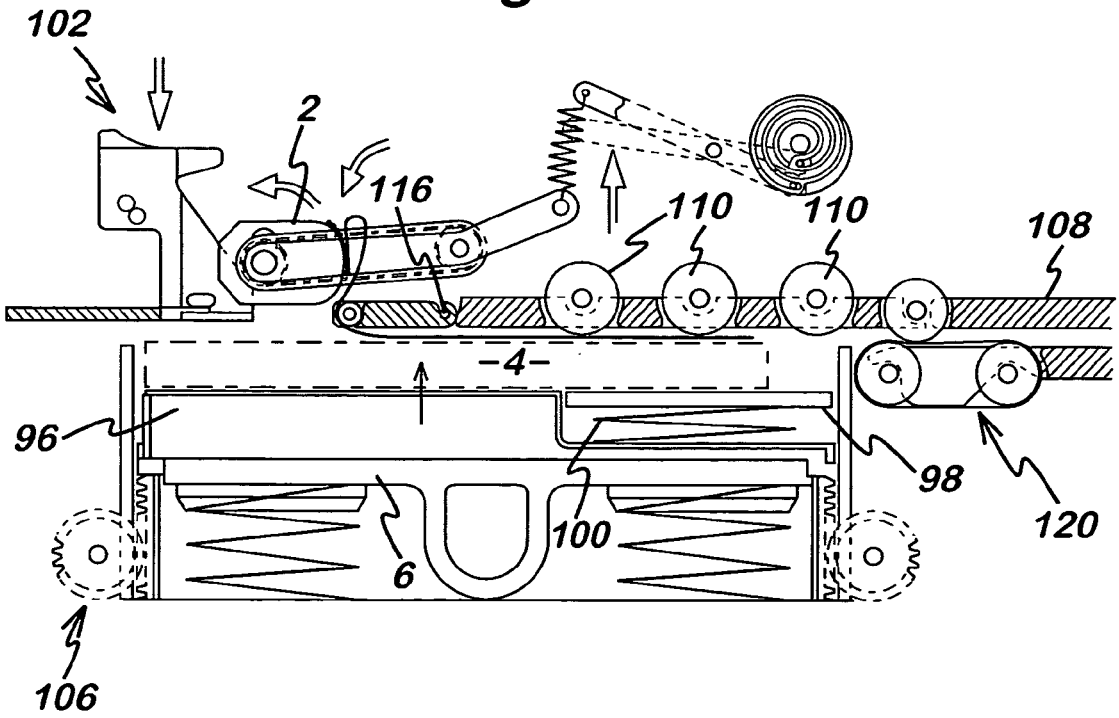

The control means 180 first causes the cam 82 to be rotated to a position determined by the banknote's denomination and/or condition. This will determine the initial pressure exerted by the roller 2. The roller 2 is then rotated by a motor (not shown) under the control of the store control means 180. When part 112 of roller 2 bears upon notes 4 the top note is caused to buckle, as shown in FIG. 7*b*. This occurs due to the friction between the roller 2 and the uppermost banknote. FIG. 7*c* shows the buckle being further formed. The arc length 112 of roller 2 still acts upon the banknote due to the friction between them.

The conveying apparatus further comprises sensing means 184 (FIG. 7*a*) to provide to the store control means 180 a signal indicating whether or not a buckle has formed. The sensing means may, for example, be a light-emitting diode coupled with a photo sensor. If a buckle is formed it is projected by the roller into the path of the light from the LED and hence obscures the light to the photo sensor.

If the buckle is not formed the roller is caused by the control means 180 to be rotated full circle so the arc length 112 is brought back into contact with the top banknote. However, cam 82 is rotated clockwise to send end 84 of lever 80 towards the outermost part of the spiral in cam 82. This causes end 84 of lever 80 to be lowered, thus raising the other end. This causes spring 8 to be lifted, which in turn lifts the end of lever 18 remote from roller 2. Thus roller 2 is urged further towards the stack of banknotes 4. As a result the frictional force between roller 2 and the uppermost banknote will be greater than during the first rotation of roller 2.

The cam 82 can be rotated clockwise in steps, increasing the pressure of the roller 2 on the stack of banknotes with each step. Thus the pressure is increased with each rotation until the sensor detect that a buckle in the banknote has been formed.

Figure 7D:
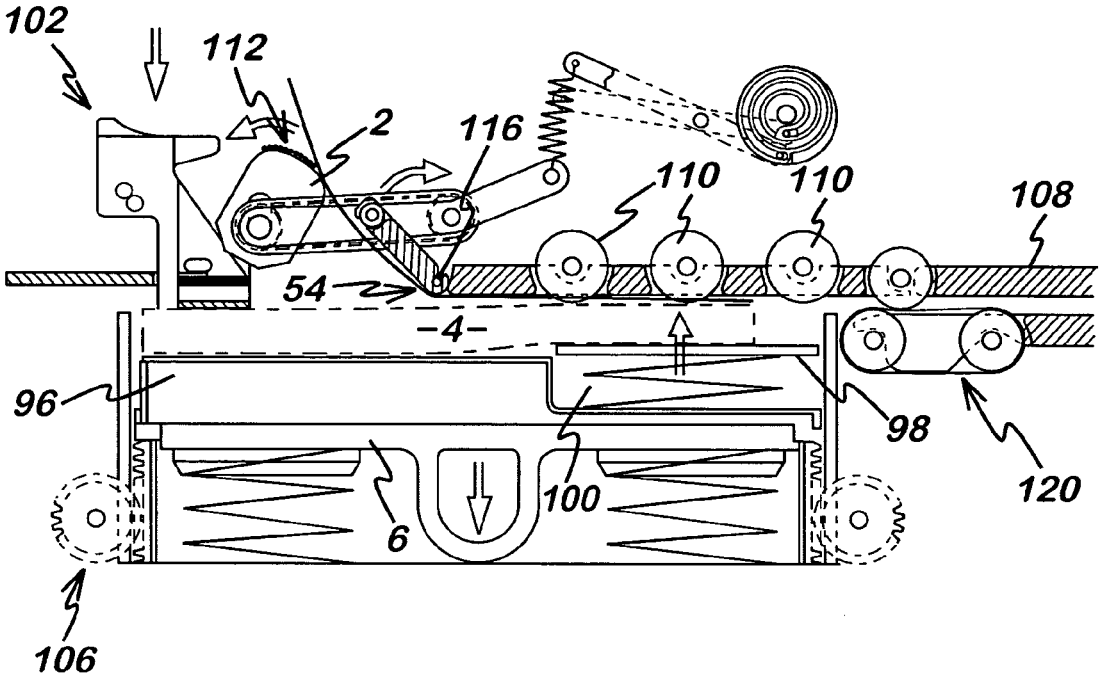
Figure 7E:
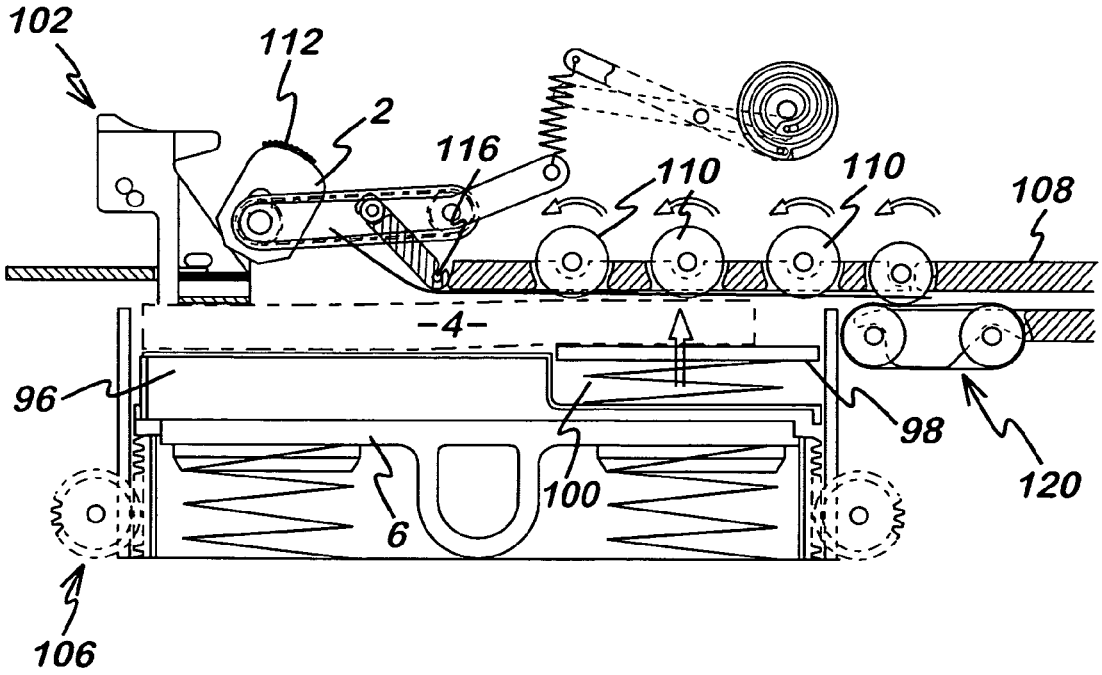
Figure 7F:
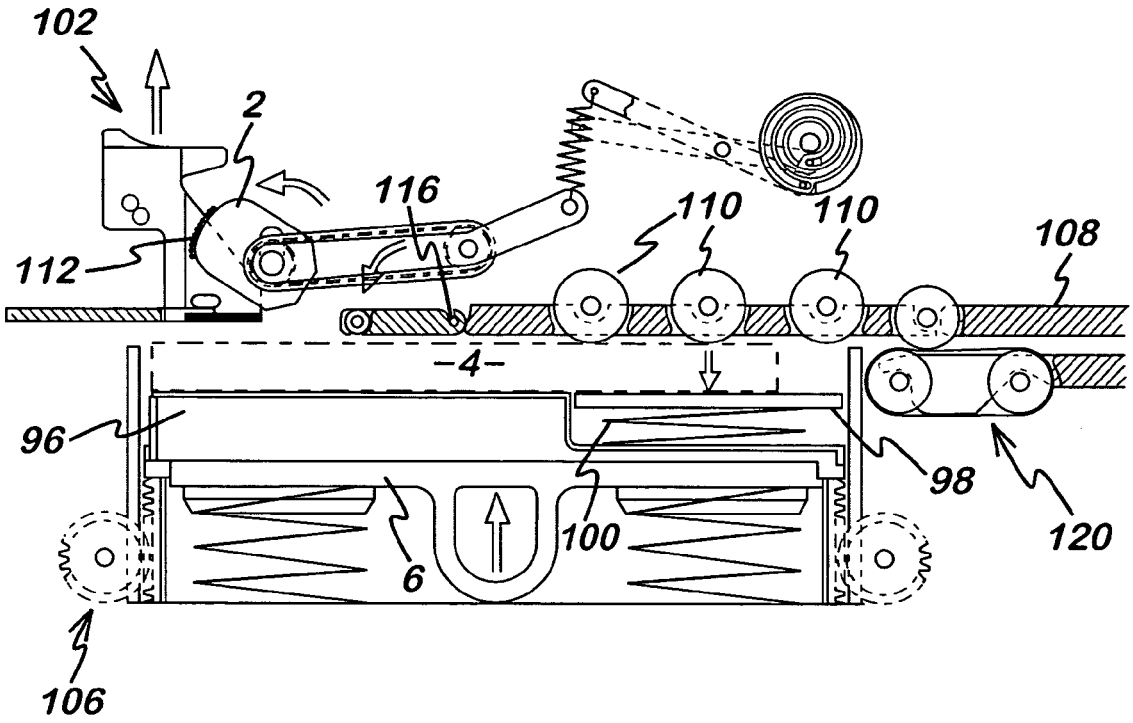

FIG. 7*d* shows an instance in the sequence of bill extraction from a stack as the roller continues rotating after a buckle has been formed. The arc length 112 loses contact with the bill which straightens out. In order to aid this process an end part 114 of the flat member 108 which is hingedly mounted to the rest of the member 108 is urged upwardly about pivot 116 by an actuator 186 (FIG. 7*a*) under the control of control means 180. This creates more space for the buckle in the note to deform and allow the note to straighten. This arrangement is of particular use when the notes to be dispensed are rigid, whether because of the particular currency or because the note is new, because it reduces the force required in the subsequent note extraction operation, due to the fact that the radius of curvature of the note in the region 54 is increased.

The pressure member 102 is urged downwardly against the stack of notes 4. Thus one end of the stack of notes (with the exception of the note associated with the roller 2) is clamped against the platform 6 in the area exposed by the buckled uppermost note. The clamping force applied by the pressure member 102 causes platform 6 to be depressed. However, since pusher plate 98 is not acted upon, the end of the stack 4 not clamped by the pressure member 102 remains substantially at its original height, and thus engaged with driving wheels 110.

After clamping, the drive wheels 110 on the member 108 are driven (anti-clockwise in FIGS. 7*a–f*). Friction between the drive wheels and uppermost note will cause the uppermost note be dispensed from the stack 4 and propelled onto the conveyor belt 120. This step of the sequence is shown diagrammatically in FIG. 7*e*.

The apparatus is then reset.

The end part 114 may be caused to flex at a predetermined point in the roller's rotation cycle, or may be caused to flex in response to a signal from a sensor, such as the buckle sensor. Alternatively, the end part 114 may be free throughout the cycle to move against a biasing force, to achieve a similar effect to the flexible member 40 of FIGS. 5 and 6.

Embodiments described above are intended for dispensing notes individually from stacks thereof. The features described in respect of individual embodiments can also be used in the other described embodiments. For example, in the embodiment of FIGS. 7*a* to 7*f*, the member 108, including the end part 114, could be replaced by the flexible member 40 of FIGS. 5 and 6. Additionally or alternatively, the lever 80 and cam 82 arrangement may be substituted by an electromagnet arrangement as described above.

In the embodiments of FIGS. 4*a* and 4*b* and FIGS. 7*a* to 7*f*, wherein the note is moved by a moving means constituted by the roller 2 and the member 40 or 108, the upper note is buckled within a fixed region between the roller 2 and the end of the member 40 or 108, but the pressure of the roller can be varied to cope with banknotes of different stiffness. In an alternative embodiment, roller 2 is rotatably mounted on a support for movement along a plane parallel to the banknotes 4. In this aspect the distance between the roller 2 and the member 40 or 108 may be varied.

Since banknotes have varying rigidity it can require different pressures to cause the note to buckle. However, creating a greater distance between roller 2 and the member 40 or 108 makes it easier for the buckle to form. In general, the greater the distance between the points attempting to create the buckle, the greater the chance of forming a buckle. It is to be understood that if the distance is too great the roller may urge a plurality of notes to form buckles and hence an incorrect amount of notes would be dispensed.

The roller is so mounted as to be able to be moved back and forth along its plane of linear movement in a plurality of steps. This allows a gradual increase in the distance between roller 2 and articulated member 40 or 108.

Accordingly, varying the distance between the roller and the member 40 or 108 can be used instead of (or in addition to) varying the pressure of the roller 2 to cope with notes of different stiffness.

The skilled man will readily understand that the variation of this distance can be achieved by moving either the roller, or the member 40 or 108, or both.

All the various arrangements described above could be arranged to vary the effectiveness of the note moving means (i.e. the pressure of the roller 2, or the distance between the roller 2 and the member 40 or 108) in accordance with the type of banknote and/or the detection of movement of the banknote (e.g. detection of the formation of the buckle). It is particularly desirable to use both these parameters, as in the arrangement described with reference to FIGS. 4*a* and 4*b*, because this allows very rapid adjustment in accordance with the type of banknote, and then a fine adjustment in accordance with detection of movement, thereby allowing reliable operation to occur rapidly. In addition to or instead of taking into account the banknote denomination, other parameters such as a measured condition of the banknote may be used to control the operation of the moving means. The banknote condition may be measured for other purposes, for example to determine whether it is suitable for dispensing. In this way, it is possible for the system to take account of banknotes which have been weakened due to age. The adjustment of the note moving means could additionally or alternatively be responsive to detection of a feeding error, such as feeding of two (or more) sheets instead of a single sheet.

Further embodiments are concerned with transport and/or alignment of individual banknotes, rather than removable from a stack.

A further embodiment is shown by FIG. 8. In this case the electromagnet 14 is disposed below the lever 18. In this embodiment the roller 2 is disposed opposite an opposing member 50. The arrangement shown by FIG. 8 is typically used to drive individual banknotes 92 one at a time. In this embodiment the roller 2 is urged towards opposing member 50. Typically opposing member 50 comprises a roller. The notes are fed into the device in the direction of the arrow. The sensor detects whether the banknote 92 has been driven through the device. If not, the pressure exerted on the opposing member 50 by the roller 2 is increased, as described above. Typically the sensor may comprise an LED 16 disposed opposite a photodiode 80.

The present invention is also suitable for use in automatic alignment devices. These devices are capable of receiving a sheet and moving it into alignment.

FIG. 9 shows the functional elements of an automatic alignment device in accordance with the present invention. Banknotes are driven in to the device along platform 6 in the direction indicated by the arrow. To one side of the apparatus is a wall 26 against which the banknotes are aligned.

Two sets of sensors 28 are disposed close to the wall. The sensors are typically light sensors consisting of opposed LEDs and photodiodes. The machine may sense when a banknote is aligned against the wall 26 by detecting if both sensors are blocked. If light emitted from one of the LEDs is detected by its corresponding photodiode then the banknote is not correctly aligned.

The apparatus also comprises a drive wheel 30 disposed with its axis of rotation at an angle to the perpendicular of the drive path. The drive wheel 30 is rotatably driven. The drive wheel 30 may be intermittently driven, preferably alternately with another drive mechanism for driving the banknotes along a transport path.

A problem with apparatus of this kind is that it suffers from not being able to differentiate between banknotes of different thickness and rigidity. In this embodiment the pressure subjected by the drive wheel 30 on the flexible media may be governed using any of the principles described previously. In this regard the drive wheel 30 may be mounted upon a pivoted lever, whilst the end of the lever remote from the drive wheel may be acted upon by an opposed electromagnet and compression spring. It is to be understood that, as described above, a motor and cam arrangement may be substituted for the electromagnet and spring arrangement.

When banknotes are fed into the device the drive wheel 30 urges them towards the wall 26. If the sensors 28 do not detect the presence of a banknote the pressure exerted on the banknote by the drive wheel 30 is increased. The process is iterated until both the sensors 28 are blocked and thereby detect the presence and correct alignment of a banknote. In this manner it is possible automatically to take account of the age and type of banknote being aligned.

It is to be understood that the above mentioned specific embodiments are included by way of example only and that many modifications and variations are included within the scope of the invention. For example, in the arrangements described above in which the endmost banknote of a stack is buckled at one end thereof, the banknote is then transported away from the stack by moving it such that the opposite end has the leading edge. This is advantageous as compared with the more complicated prior art arrangements in which the banknote is moved with the buckled end having the leading edge. However, this alternative possibility could be employed instead.

The invention claimed is:

1. A value sheet handling apparatus comprising:

moving means for moving at least part of a sheet, wherein the moving means is operable to buckle the sheet, the moving means being adjustable in order to increase the force applied onto the sheet, to thereby be more likely to cause movement of the sheet, and control means for adjusting the moving means automatically in response to detection of a predetermined condition, wherein the control means is operable, when a value sheet is to be moved, to adjust the moving means to an initial state which is dependent on the type of the value sheet, and then adjusting to the moving means to successive states until the sheet moves.

2. A value sheet handling apparatus as claimed in claim 1, further comprising means to detect whether or not the value sheet has been moved, the control means being responsive to the detecting means for increasing the force applied by the moving means until the value sheet is moved.

3. A value sheet handling apparatus as claimed in claim 1, wherein the control means is operable to adjust the moving means in predetermined discrete steps.

4. A value sheet handling apparatus as claimed in claim 1, wherein the moving means comprises an electromagnet for permitting adjustment thereof.

5. A value sheet handling apparatus as claimed in claim 1, wherein the moving means comprises a motor and cam arrangement for permitting adjustment thereof.

6. A value sheet handling apparatus as claimed in claim 1, the apparatus being operable to dispense value sheets from a stack.

7. A value sheet handling apparatus as claimed in claim 1, arranged to dispense value sheets from a stack, and having means operable, when the value sheet is buckled, to clamp the remainder of the stack in the area exposed by the buckling of the sheet.

8. A value sheet handling apparatus comprising:

moving means for moving at least part of a sheet, wherein the moving means is operable to buckle the sheet, the moving means being adjustable in order to increase the force applied onto the sheet, to thereby be more likely to cause movement of the sheet, and control means for adjusting the moving means automatically in response to detection of a predetermined condition, wherein adjustment of the moving means causes an alteration of the distance over which the buckle is to be formed.

9. A value sheet handling apparatus as claimed in claim 8, wherein adjustment of the moving means causes an alteration of the distance over which the buckle is to be formed.

10. A value sheet handling apparatus operable to dispense value sheets from a stack by buckling an endmost sheet of the stack, and having means operable, when a value sheet is buckled, to grip the remainder of the stack, and arranged such that the value sheet has a first end which is buckled and a second, opposite end, wherein the apparatus comprises means for transporting the sheet, after the first end has been buckled, with the second end having the leading edge.

11. A value sheet handling apparatus as claimed in any one of claims 9, 7, or 10, having a member for restraining the sheet being buckled, the member being resiliently displaceable by the sheet so that the geometry of the buckle is dependent on the stiffness of the sheet.

12. A value sheet handling apparatus as claimed in any one of claims 1, 8 or 10, arranged to handle banknotes.

13. A value sheet handling apparatus operable to dispense value sheets from a stack by buckling an endmost sheet of the stack, and having a member for restraining the sheet being buckled, whereby the sheet is curved in the region where the buckle engages the member, and an actuator for displacing the member prior to moving the sheet off the stack in a direction substantially parallel to the plane of the sheet so as to increase the radius of curvature of the sheet in said region.

14. A value sheet handling apparatus as claimed in claim 13, wherein the stack is mounted upon a platform such that the platform is depressed under the action from the gripping means.

15. A method of handling a value sheet comprising:

causing an actuating mechanism to exert pressure onto a value sheet so as to move at least part of the value sheet; and controlling the pressure applied by the actuating mechanism dependent upon the type of value sheet to be actuated and then adjusting moving means to successive states until the sheet moves.

16. A value sheet handling apparatus operable to dispense a value sheet from a stack of value sheets, each sheet comprising substantially aligned first ends, and opposite second ends, the apparatus comprising:

means to form a buckle in the first end of a sheet to be dispensed, such that the first end of the subsequent sheet is exposed;

means to engage the exposed first end of the subsequent sheet, and thereby clamp the remaining stack; and means to dispense the top sheet from the stack with the second end of said top sheet being a leading edge.

17. A value sheet handling apparatus having moving means for moving at least part of a sheet, the moving means being adjustable in order to make the force applied thereby more likely to cause movement of the sheet, the apparatus further including control means for adjusting the moving means, whereby, when a value sheet is to be moved, said control means adjusts the moving means to an initial state which is dependent on the type of value sheet, and then adjusting to the moving means to successive states until the sheet moves.

* * * * *

UNITED STATES PATENT AND TRADEMARK OFFICE

CERTIFICATE OF CORRECTION

PATENT NO. : 7,100,913 B2
APPLICATION NO. : 10/326202
DATED : September 5, 2006
INVENTOR(S) : Guillermo Garcia, Andre Gerlier and Roberto Polidoro It is certified that error appears in the above-identified patent and that said Letters Patent is hereby corrected as shown below:

On the Title Page Item (57) line 7 Abstract, "actuating mechanism the pressure exerted Onto die flexible media" should be --actuating mechanism the pressure exerted onto the flexible media--

Signed and Sealed this

Tenth Day of June, 2008

JON W. DUDAS
*Director of the United States Patent and Trademark Office*